United States Patent [19]

Cross

[11] Patent Number: 4,958,462

[45] Date of Patent: Sep. 25, 1990

[54] LOCKING PIVOT SHOE

[76] Inventor: Rex D. Cross, No. 1 Old Church Rd., Greenwich, Conn. 06830

[21] Appl. No.: 361,528

[22] Filed: Jun. 5, 1989

[51] Int. Cl.[5] ..... E05D 15/22

[52] U.S. Cl. ..... 49/181

[58] Field of Search ..... 49/181, 446, 453, 445

[56] References Cited

U.S. PATENT DOCUMENTS

| | | | |
|---|---|---|---|
| 2,778,068 | 1/1957 | Kaufman et al. | 20/49 |
| 3,055,062 | 9/1962 | Peters et al. | 20/42 |
| 3,055,063 | 9/1962 | Peters | 49/181 X |
| 3,184,784 | 5/1965 | Peters | 16/171 |
| 3,399,490 | 9/1968 | Hettinger | 49/414 |
| 3,482,354 | 12/1969 | Trout | 49/181 |
| 4,068,406 | 1/1978 | Wood | 49/181 |
| 4,363,190 | 12/1982 | Anderson | 49/181 |
| 4,452,012 | 6/1984 | Deal | 49/181 |
| 4,590,708 | 5/1986 | Campodonico | 49/181 |
| 4,610,108 | 9/1986 | Marshik | 49/181 |
| 4,718,194 | 1/1988 | Gibbon et al. | 49/181 |

*Primary Examiner*—Philip C. Kannan

*Attorney, Agent, or Firm*—Robert A. Seemann

[57] ABSTRACT

A body for sliding in a track, and a rotary barrel cam. One portion of the body has two legs defining a separation zone between them for divergent movement of them. They further define within the zone, a passage in the body, for receiving the barrel cam. The barrel cam is mounted in the passage for rotation, about an axis that is generally normal to one wall of the track.

The barrel cam and the body define between them an axial thrust cam for forcing part of the pivot shoe axially with respect to the axis, against an inner surface of the track when the barrel cam is rotated.

An axially slidable brake pad is located over the barrel cam for engaging the inner surface of the track when the barrel cam is rotated.

The barrel cam and the body also define between them a radial thrust cam for forcing a leg radially with respect to the axis against an inner surface of the track when the barrel cam is rotated.

The body is adapted for receiving external elements for urging the body along the track.

10 Claims, 5 Drawing Sheets

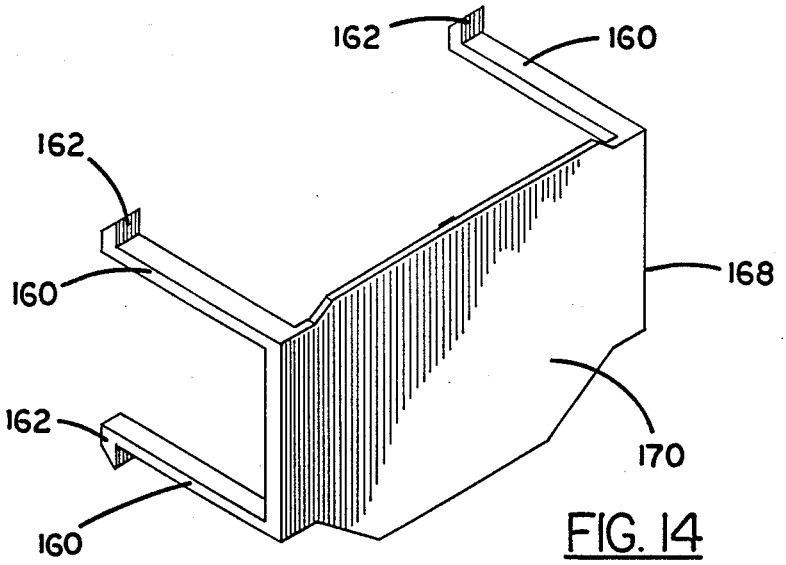
FIG. 14
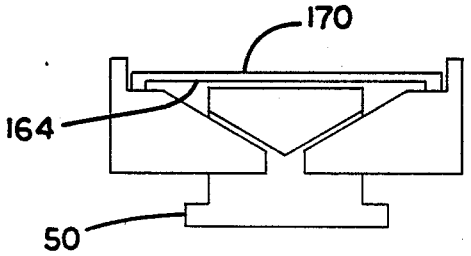
FIG. 15
FIG. 16
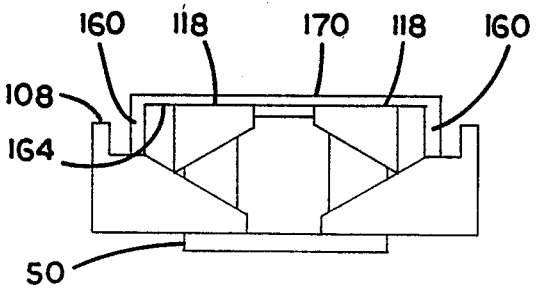

LOCKING PIVOT SHOE

BACKGROUND OF THE INVENTION

1. Field of the Invention

This invention relates to movable closures, more specifically to a pivot mechanism mounted on a sliding window sash and located in the window jamb track for sliding one end of the sash along the track, and for preventing sliding, by pressing against the track when another end of the sash is rotated away from the track on the pivot mechanism.

2. Description of the Prior Art

Locking pivot shoes which lock in a window jamb track by bearing against some part of the track are disclosed in the prior art by many different designs.

In U.S. Pat. No. 2,778,068, patented Jan. 22, 1957 by A. Kaufman et al., an eccentric washer, located on a sash pivot shaft, protrudes through a slot in one side of the shoe bearing against a side wall of the track as the shaft is turned by the sash when the sash is rotated away from the track.

Elements which bite into the track are disclosed in Deal U.S. Pats. U.S.P.N. 4,452,012, June 5, 1984, and Marshik, U.S.P.N. 4,610,108, Sept. 9, 1986.

Deal discloses a cylinder concentrically mounted on the sash pivot shaft. The window jamb end of the cylinder which faces the bottom of the track is a cam which operates a bite spring mounted on the shoe. The bite spring is angled to resist the upward pull of the sash balance mechanism when the cam forces the end of the bite spring against the bottom of the track when the sash is rotated away from the track.

Marshik discloses a barrel cam concentrically mounted on the sash pivot shaft. A U shaped spring with outwardly directed serrated ends is fully seated around the cammed outer diameter of the barrel within the shoe. The serrated ends of the spring rest within slots in the sides of the shoe. When the sash is rotated, the cam surface of the barrel spreads the legs of the U spring, forcing the serrated ends outward by way of the slots, into the side walls of the track.

An assembly in which the top of the track is gripped by a shoe assembly is disclosed by D. M. Hettinger, Sept. 3, 1968 in U.S. Pat. No. 3,399,490. The track includes flanges which extend from the top edge of the side walls, over the channel so that a pair of longitudinal top walls are formed on each side of the track with slit opening access to the track.

A sash pivot shaft extends through the access slit and terminates in a first retainer disk. A plastic slider body is retained on the shaft between the retainer disk and the top walls, that is, the top inner faces of the track. A second cam disk on the pivot shaft is located above the top, with the cam surface engaging the outer faces of the top walls. The top walls roll inward toward the channel of the track, forming a longitudinal transition of the access slit for mating with the cam face. When the sash is rotated, the cam, riding out of the transition, pulls the shaft back, drawing the first disk up toward the top walls so that it forces the slider body against the inner faces of the top walls.

Assemblies which lock by bearing against side walls of the track for example, are disclosed in U.S. Pat. No. 3,055,062, Sept. 25, 1962, by L. E. Peters et al., and in U.S. Pat. No. 4,068,406, Jan. 17, 1978 by Wood.

Peters describes an assembly having a sash pivot shaft with a barrel cam portion. The slider body within the track is split into two legs at one end by a slot that is shaped to conform to the barrel cam when the sash is oriented with the track for sliding. When the sash is rotated away from the track, the cam spreads the legs so that they press into the inner faces of the side walls of the track.

Wood discloses a barrel cam within a slider body which is located in the track. The barrel cam includes a notch and snap-in retainer plug for receiving the sash pivot shaft. Apertures on each side of the slider body hold pistons which are forced outward by the barrel cam against the inner faces of the side walls of the track, when the cam is rotated by the sash as the sash is tilted away from the track.

In U.S. Pat. No. 4,718,194, patented Jan. 12, 1988, FitzGibbon et al. discloses a slider body diagonally split at one end. The split includes a portion shaped to conform to a sash pivot shaft actuated barrel cam when the sash is oriented with the track for sliding. One of the legs established by the split in the slider body includes a pin. The pin is forced against an inner face of a side wall of the track when the legs are spread by the cam as it rotates with the tilting window.

Assemblies which lock by bearing against the bottom of the track include those described by L. E. Peters, U.S. Pat. No. 3,184,784, May 25, 1965, D. M. Trout, U.S. Pat. No. 3,482,354, Dec. 9, 1969, and Anderson, U.S. Pat. No. 4,363,190, Dec. 14, 1982.

L. E. Peters discloses a sash pivot shaft entering the track through a longitudinal access slit formed by a pair of top walls of the track. A slider body, residing in the track includes a recess in the top facing surface, contoured for receiving a cam disk. A cam disk on the shaft is located below the inner faces of top walls, the bottom facing surface of the disk having the cam contour. The cam disk sits low in the recess when the sash is aligned with the track. When the sash is tilted from the track, the cam disk forces the slider body against the bottom of the track as the top facing surface of the disk is forced against the inner faces of the top walls.

In Trout, the center of the bottom wall of a track includes a longitudinal rib. The top of the track includes a pair of longitudinal top walls. A slider body located within the track includes a rotary spacer cam at the side facing the bottom wall, which is turned by the sash pivot shaft. The cam face of the spacer is grooved and mates with the ribbed wall. The cam is seated lowest when the sash is aligned with the track. When the sash is tilted, the cam is rotated out of alignment with the rib, and rises from the bottom wall to force the slider body against the inner faces of the top walls.

Anderson discloses a track with a pair of longitudinal top walls. A slider body located within the track includes a rotary spacer cam at the side facing the bottom wall, which is turned by the sash pivot. The cam is divided approximately into semicircles, with flats between them of lesser diameter. Resilient fingers mounted on the slider body parallel the flats on each side of the spacer cam when the sash is aligned with the track. When the sash is tilted, the cam is rotated so that portions of the cam are forced under two fingers, forcing them against the bottom wall as the slider body is held in the opposite direction by the inner faces of the top walls.

SUMMARY OF THE INVENTION

It is one object of the invention to provide a locking pivot cam which requires a minimum of relatively moving parts.

It is another object of the invention to provide a locking pivot cam which bears against at least three walls of the track for locking.

Another object is to provide a locking pivot cam in which the rotating part does not rotate across the edges of the access slit of the top walls of the track.

Another object is to provide a locking pivot cam which is inexpensive to manufacture.

Still another object of the invention is to provide tough and durable locking pivot cam mechanism which does not need thin flexible elements for its operation.

Other objectives and advantages will become apparent from the ensuing description.

In accordance with the invention, the pivot shoe comprises a body for sliding in a track having first, second and third walls which include respectively, a first, second and third inner surface. When the body is in the track, a first side of the body faces the first surface, a second side faces the second surface and a third side faces the third surface.

One portion of the body has two legs defining a separation zone between them for divergent movement of them. They further define within the zone, a passage in the body, for receiving a barrel cam which is also part of the pivot shoe. The barrel cam is mounted in the passage for rotation by rotation transmission means, about an axis that is generally normal to the first wall.

The barrel cam and the body define between them an axial thrust cam for forcing part of the pivot shoe axially with respect to the axis, against an inner surface of the track when the barrel cam is rotated.

The barrel cam and the body also define between them a radial thrust cam for forcing a leg radially against an inner surface of the track when the barrel cam is rotated.

In one embodiment of the invention, a brake pad extends over one end of the barrel cam, and is mounted on the body for axial movement, so that the brake pad is forced against an inner surface of the track by an axial thrust cam defined between the barrel cam and the body.

The body includes means for receiving means for urging the pivot shoe slidingly along the track.

BRIEF DESCRIPTION OF THE DRAWINGS

In order that the invention will be more fully comprehended, it will now be described, by way of example, with reference to the accompanying drawings, in which:

FIG. 14 is a rear perspective view of a brake element for the pivot shoe shown in FIG. 12.

FIG. 15 is a schematic view of one barrel cam axial thrust position, in a pivot shoe including the brake element shown in FIG. 14.

FIG. 16 is a schematic view of one barrel cam axial thrust position, in a pivot shoe including the brake element shown in FIG. 14.

DESCRIPTION OF THE PREFERRED EMBODIMENTS

Figure 1:
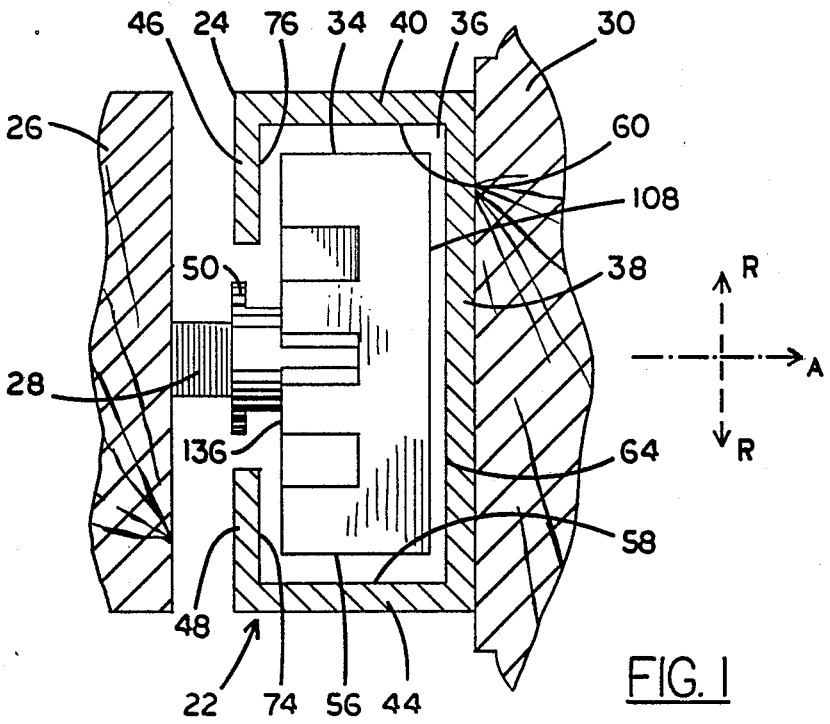
FIG. 1 is a top view of a pivot assembly.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1 of the drawings, window pivot assembly 22 includes track 24 attached to window jamb 30. Sash 26 tilts on pivot shaft 28 so that the sash can be positioned generally coplanar with, or else angled parallel to, the track. While sash 26 is coplanar with the track, it can be slid along the track as it is guided along the track by slider body 34.

Slider body 34 moves within channel 36 which is defined by bottom wall 38, back side wall 40, front side wall 44, back top wall 46 and front top wall 48.

Pivot shaft 28 is received in barrel cam 50 which cams axially (arrow A) and radially (arrow R) for friction locking slider body 34 against movement in channel 36 when sash 26 is tilted away from the plane or longitudinal direction of the track.

FIG. 1 shows sash 26 oriented parallel with the track, configured for opening and closing the window by sliding the sash along the track. Slider body 34 has sufficient clearance from the walls for rattle-free guiding of the sash along the track.

Slider body 34 and pivot shaft 28 comprise locking pivot shoe 56.

For purpose of discussion, front side wall 44 is toward the inside of a room, back side wall 40 being toward the outside of the room.

Figure 2:
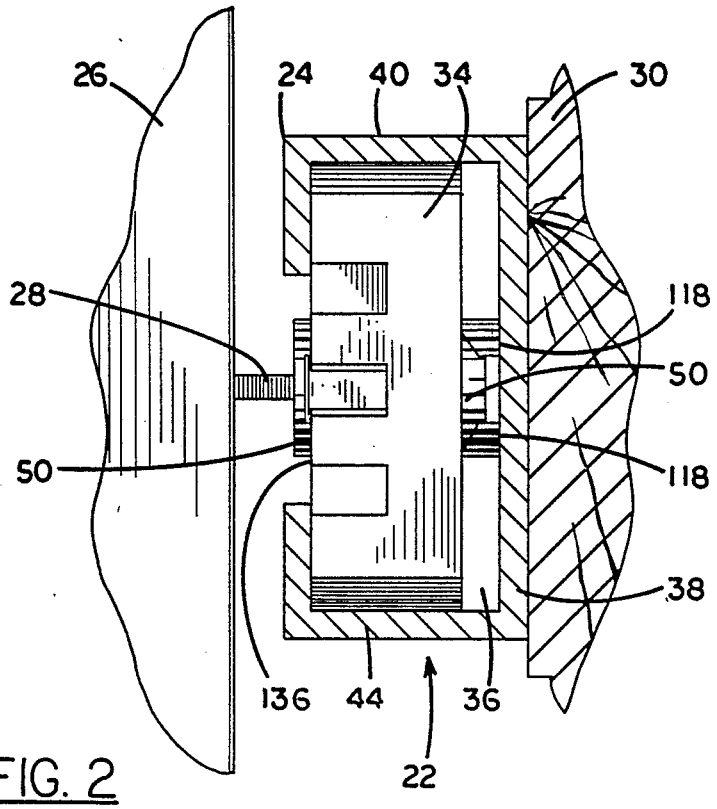
FIG. 2. is a top view of the pivot assembly shown in FIG. 1, with the sash rotated.

FIG. 2 shows sash 26 angled from the parallel with respect to the track. The sash is located at some selected point along the track, and with its center of rotation at pivot shaft 28, sash 26 is tilted into the room. As will be explained in greater detail, barrel cam 50, rotated by pivot shaft 28, radially cams portions of slider body 34 so that it presses against front side wall inner face 58 and back side wall inner face 60, and also cams axially against bottom wall inner face 64, as it axially forces slider body 34 away from bottom wall inner face 64, and toward respective inner faces 74 and 76 of front top wall 48 and back top wall 46.

The angle of tilt by the sash from a parallel with respect to the track, determines the angle of rotation applied to barrel cam 50. The sequence established between the radial and axial camming actions is related to shaping of the various cam faces for operating over predetermined angular ranges of rotation.

Figure 3:
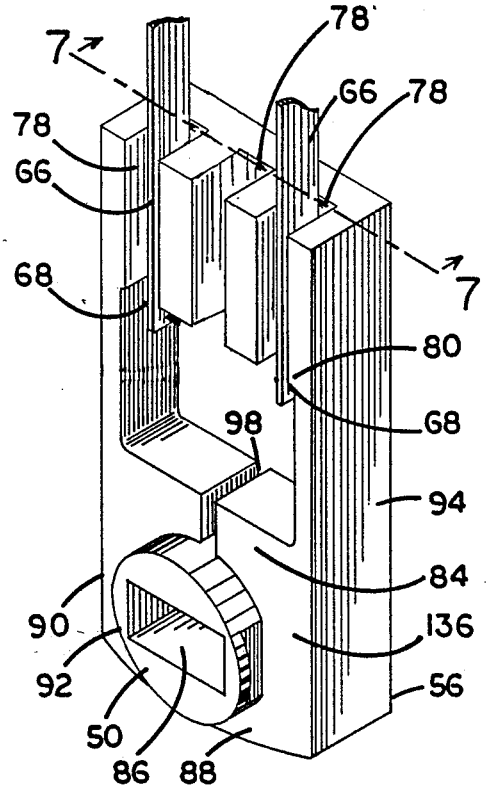
FIG. 3 is a front perspective view of a pivot shoe constructed according to the present invention.

Referring to FIG. 3, slider body 34 which is preferably constructed by molding from a durable and strong but flexible plastic such as Celcon (TM), is designed to receive a spring loaded balance assembly (not shown) which provides lifting force to counterbalance the weight of the sash. Fingers 66 from the balance assembly locate in hook slots 78, and cross pins 68 at the ends of the fingers bridge below the slots for transferring the lifting force via upper bridge portion 80 and lower bridge portion 84, to barrel cam 50. Shaft slot 86 in top end 92 of cam 50 receives pivot shaft 28, transmitting the lifting force to sash 26 by way of pivot shaft 28.

Lower bridge portion 84 is separated by slit 98 into two portions, front portion 88, and back portion 90, on legs 94 and 96 respectively. Legs 94 and 96 can be forced to spread to the full width of channel 36 without breaking, and have a natural tendency to return to neutral by their own resiliency.

Figure 4:
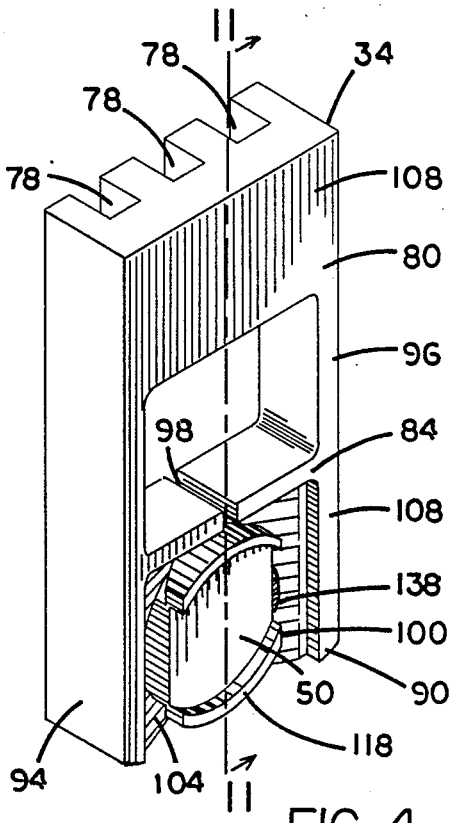
FIG. 4 is a rear perspective view of the pivot shoe.
Figure 6:
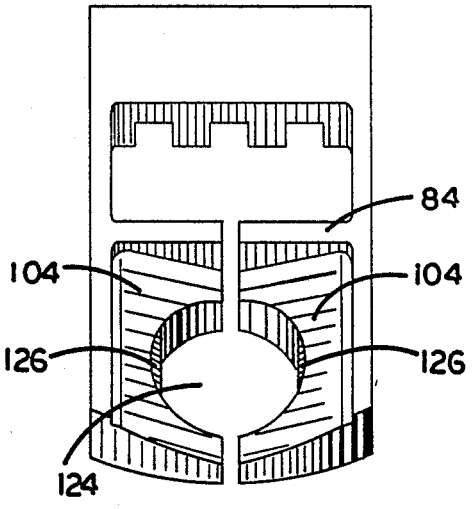
FIG. 6 is a rear perspective view of a pivot shoe body of the invention.
Figure 5:
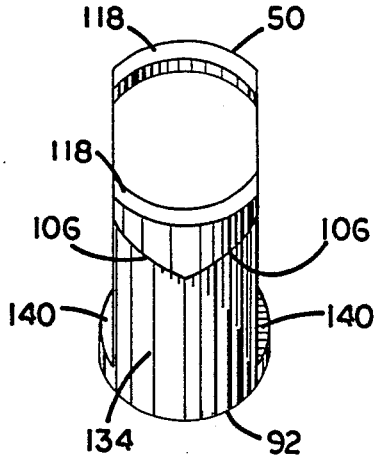
FIG. 5 is a perspective view of a barrel cam of the invention.

As shown in FIG. 4, bottom end 100 of barrel cam 50 is preferably sealed so that the pivot shaft cannot extend beyond the bottom of the cam.

Referring to FIGS. 5, 6, 9 and 10, axial cam surface 104 of lower bridge portion 84 mates with corresponding axial cam surface 106 of barrel cam 50 when the sash is coplanar with the track as shown in FIG. 1. The orientation of barrel cam 50 with respect to slider body 34 for this configuration, is as shown in FIGS. 1, 3, 4, 7, 9 and 11. Shaft slot 86 is oriented perpendicular to the longitudinal direction of the track and of balance fingers 66, as shown in FIG. 3. Bottom end 100 of barrel cam 50 is shown in FIG. 4 with the cam rotated to the same angle as it is in FIG. 3. Brake flanges 118 do not extend beyond bottom facing surface 108 of the slider body.

Figure 8:
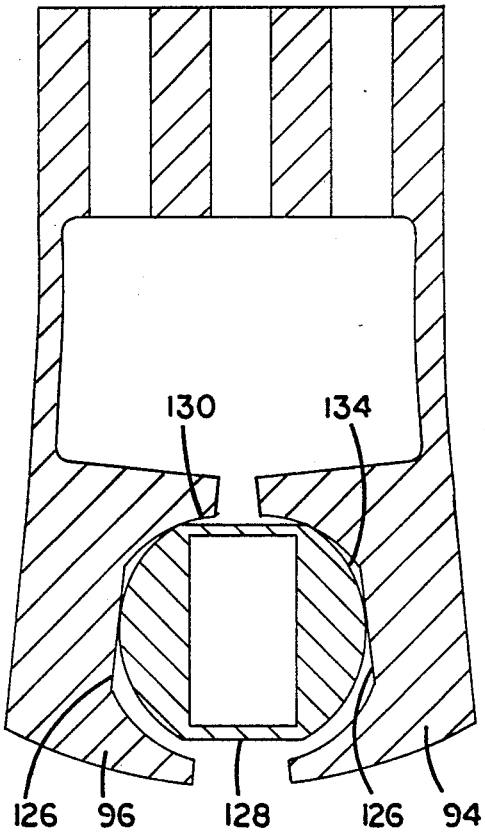
FIG. 8 is a cross sectional view as in FIG. 7, showing the barrel cam rotated to a different angle.
Figure 9:
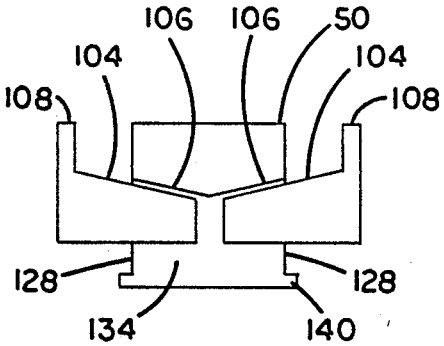
FIG. 9 is a schematic view of one barrel cam axial thrust position.
Figure 10:
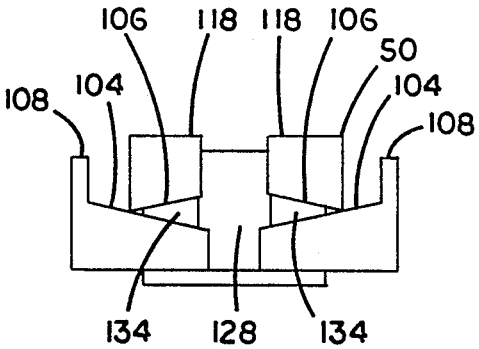
FIG. 10 is a schematic view of one barrel cam axial thrust position.
Figure 11:
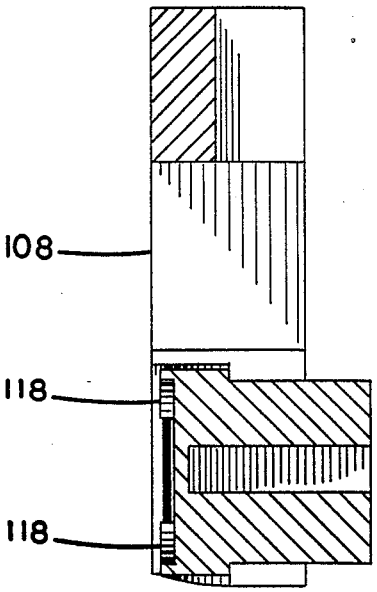
FIG. 11 is a cross sectional side view taken along lines 11—11 of FIG. 4.
Figure 12:
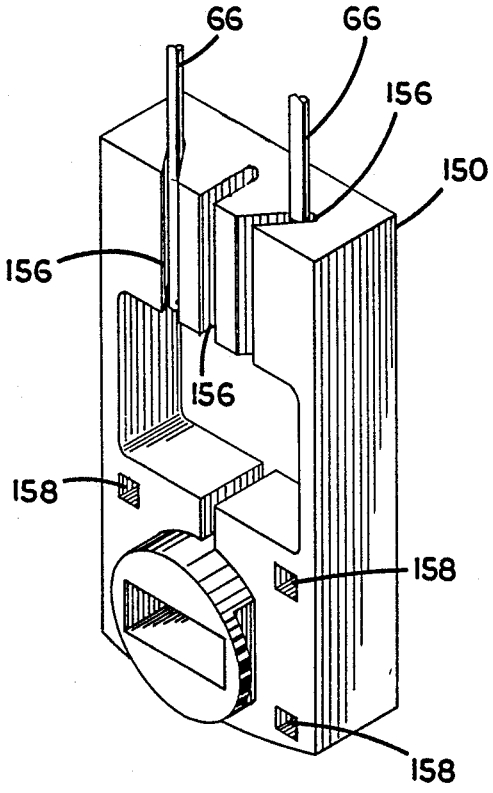
FIG. 12 is a front perspective view of a pivot shoe constructed according to the invention.
Figure 13:
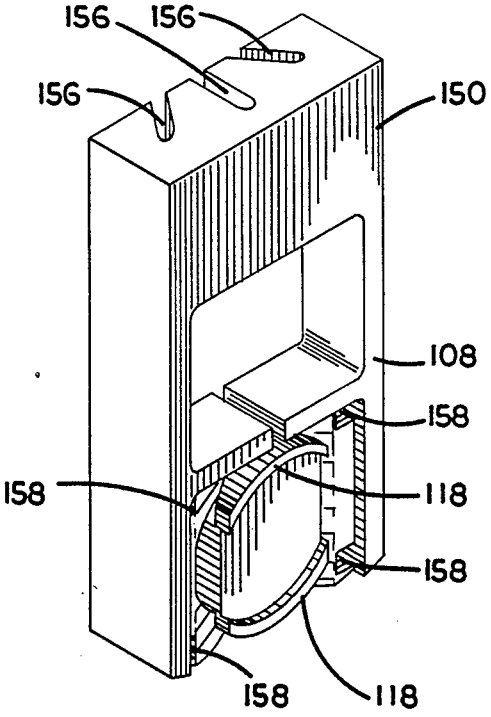
FIG. 13 is a rear perspective view of the pivot shoe shown in FIG. 12.

When the sash is tilted away from the track, pivot shaft 28 rotates barrel cam toward the full-tilt orientation represented in FIGS. 2, 8 and 10. As shown in FIG. 10, barrel cam 50 is cammed axially outward from the slider body at some predetermined range of rotation based on the shape of the cam surface, forcing brake flanges 118 to extend beyond bottom facing surface 108 of the slider body.

The brake flanges of the extended barrel cam bear axially against inner face 64 of the track to help lock slider body 34 in place within the track. Concomitantly, slider body is forced axially in the opposite direction whereupon top facing surface 136 of the slider body presses against front and back top wall inner faces 74 and 76.

Figure 7:
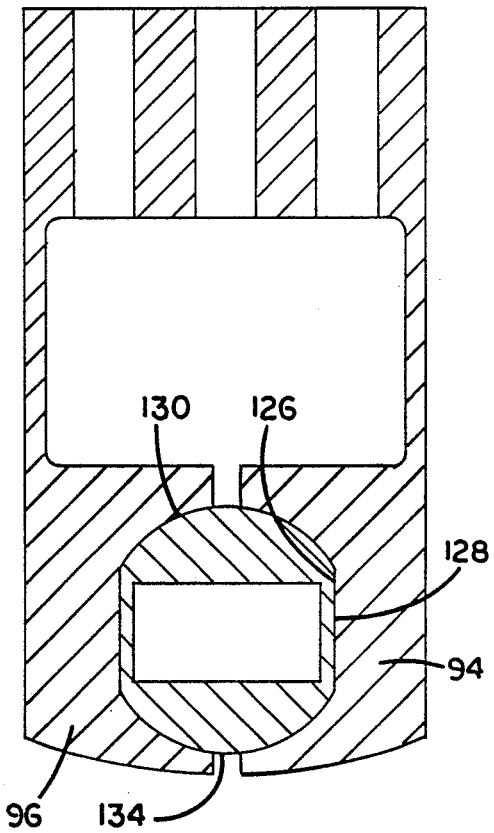
FIG. 7 is a cross sectional view taken along lines 7—7 of FIG. 3.

When the sash is coplanar with the track, radially cammed passage 124 through lower bridge portion 84 closely receives barrel cam 50 with flats 126 in alignment with complementary flats 128 on the barrel cam, and with arcs 130 of cammed passage 124 in alignment with complementary arcs 134 on the barrel cam, as shown in FIG. 7.

When the sash is tilted away from the track, arcs 134 cam legs 94 and 96 apart, as shown in FIGS. 8 and 2. The legs are spread to the full width of channel 36 at some predetermined range of rotation of the barrel cam based on the shapes of the involved cam surfaces, and press against front side wall and back side wall inner faces 58 and 60 to help lock slider body 34 within the track.

Assembly of locking pivot shoe 56 is simple. Barrel cam 50 is forced into radially cammed passage 124 through bottom facing surface 108 of the slider body, leading with the shaft slot end of the barrel cam. To ease entry of barrel cam 50 into the slider body, chamfers 138 (FIG. 4) are provided on the slider body, at the ends of flats 126 of radially cammed passage 124.

Retainer flanges 140 on the barrel cam (FIG. 5) resist sliding out of the cam when they are positioned over the flats 126. The retainer flanges are not shown on the barrel cam in FIGS. 7 and 8 for clarity of explanation with respect to those figures.

Another preferred embodiment is shown in FIGS. 12–16. Slider body 150 receives balance assembly fingers 66 (FIG. 12) in three hook slots 156. The two outer slots of the three are angled from the central slot by approximately 45 degrees for improved retention of the fingers.

Slider body 150 includes four axially oriented guideways 158 (FIG. 13) for slidably receiving guide pins 160 of brake pad 168 shown in FIG. 14. The brake pad is free to slide axially from a location at which it does not extend beyond bottom facing surface 108 of slider body 150, to a location at which it extends beyond surface 108, whereupon further extension is prevented by snap-lock tabs 162 which engage portions of the slider body.

Referring to FIGS. 15 and 16, when the barrel cam is extended, brake flanges 118 bear axially against inner surface 164 of the brake pad, pushing the outer braking surface 170 against the inner face of the track as explained for the brake pads in the earlier described embodiment, to help lock slider body 150 in place within the track.

Although it is shown in FIGS. 15 and 16 that the brake flanges do not extend beyond bottom facing surface 108 of the slider body in order to deploy the brake pad, this need not be the case. Extension beyond bottom facing surface 108 by the brake pads, or by the bottom end of the barrel cam if brake pads are not used, may be employed to push the brake pad against the track.

Although barrel cam 50 is shown with shaft slot 86 for rotation by pivot shaft 28, cam 50 can be rotated by window sash 26 by any suitable means, for example (not shown) by an extension of barrel cam 50 which keys into a mating opening on the shaft.

In the preferred embodiment shown in FIGS. 1 and 2, barrel cam 50 engages an inner face of the track for resisting sliding of the pivot shoe along the track, without the need to rotate the engagement surface of the barrel cam across a pivot shaft access slit in the track wall. It is within the contemplation of the present invention, however, to have the pivot shoe reversed in the track and to attach the barrel cam slidably with the pivot shaft so that the barrel cam can engage an inner surface of the top wall without hinderance by the shaft to axial movement of the barrel cam. It is also within the contemplation of the invention to have the pivot shoe reversed in the track and to attach the barrel cam fixedly to the pivot shaft so that the cammed axial thrust is applied between the pivot shaft and an inner surface of a track wall respectively by the barrel cam and the slider body.

Use of the locking pivot shoe of the present invention is not limited only to window assemblies. It can be used for sliding any item along a track, rotating and locking the item in place along the track by such rotation.

It is seen by the above description that the present invention provides a locking pivot shoe, which may be constructed of only two relatively moving parts, which bears against walls in four directions for locking at selected sliding positions in a track. The pivot shoe is suited for a variety of uses when operated by means for rotating the barrel cam, including for use in window assemblies in which the sash slides along a track and pivots with respect to the track.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. In an improved pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, and a fourth wall generally opposed to and spaced from the first wall, and attached to the second and third walls, said first, second, third, and fourth walls including first, second, third, and fourth inner faces respectively which define a channel for receiving the pivot shoe; the improvement comprising:

said pivot shoe comprising a body for simultaneous locking of said shoe against the four inner faces, said body including a first, a second, a third, and a fourth side of said body, a first portion of said body and a second portion of said body, said first side facing said first inner face, said second side facing said second inner face, said third side facing said third inner face, said fourth side facing said fourth inner face, and said first and second portions being oriented longitudinally with the track when said body is located within said track, said first portion comprising; a first leg and a second leg, said first and second legs defining a separation zone between them for divergent movement of said legs, and further defining between them within said separation zone, a passage in the body for receiving a barrel cam, a barrel cam having a first end and a second end, mounted in said passage for rotation by said rotation transmission means about an axis that is generally normal to said first wall, said barrel cam and said body defining between them an axial thrust cam for forcing said first end away from the first side of said body for engaging the first inner face of said track and for forcing said body into engagement with said fourth inner face of said track when the pivot shoe is located in the channel, for resisting sliding of said pivot shoe along the track when the barrel cam is rotated over a first angle of a predetermined angular range, said axial thrust cam also being for permitting retreat of said first end of said barrel cam from the first inner face of said track and said body from said fourth inner face when the barrel cam is rotated over a second angle of said predetermined angular range.

said barrel cam and said first leg defining between them a radial thrust cam for forcing said leg away from the axis of said barrel cam for engaging a one of the second and third inner faces of the track by said first leg and the other of the second and third faces by the body when the pivot shoe is located in the channel, for resisting sliding of said pivot shoe along the track when the barrel cam is rotated over a third angle of said predetermined angular range, said radial thrust cam also being for permitting retreat of said first leg and said body from said engagement with the second and third inner faces of the track when said barrel cam is rotated over a fourth angle of said predetermined angular range.

said first and third angles of said predetermined angular range generally coinciding.

2. The pivot shoe as described in claim 1, further comprising:

said second and fourth angles of said predetermined angular range generally coinciding.

3. The pivot shoe as described in claim 1, further comprising:

said barrel cam and said second leg defining between them a radial thrust cam for forcing said second leg away from said first leg for engaging an inner face of the track by said second leg when said first leg is engaging an inner face of said track.

4. The pivot shoe as described in claim 3, further comprising:

said axial thrust cam comprising said first side of said body and further comprising an axially cammed surface adjacent to said passage, and said barrel cam extending over said radially cammed surface for engaging said radially cammed surface.

5. The pivot shoe as described in claim 1, further comprising:

said second portion of said body comprising means for receiving means for urging said pivot shoe slidingly along said track.

6. The pivot shoe as described in claim 1, further comprising:

said first wall comprising an opening extending a length of said track for access to said barrel cam by said rotation transmission means.

7. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, a first portion of said body and a second portion of said body, said first side facing said first inner face, said second side facing said second inner face, and said third side facing said third inner face, and said first and second portions being oriented longitudinally with the track when said body is located within said track, said first portion comprising;

a first leg and a second leg, said first and second legs defining a separation zone between them for divergent movement of said legs, and further defining between them within said separation zone, a passage in the body for receiving a barrel cam, a barrel cam having a first end and a second end, mounted in said passage for rotation by said rotation transmission means about an axis that is generally normal to said first wall, said first end of said barrel cam and said first side of said body defining between them an axial thrust cam for forcing said first end away from the first side of said body for engaging the first inner face of said track when the pivot shoe is located in the channel, for resisting sliding of said pivot shoe along the track when the barrel cam is rotated over a first angle of a predetermined angular range, said axial thrust cam also being for permitting retreat of said first end of said barrel cam from the first inner face of said track when the barrel cam is rotated over a second angle of said predetermined angular range, said barrel cam and said first leg defining between them a radial thrust cam for forcing said leg away from the axis of said barrel cam for engaging an inner face of the track by said first leg when the pivot shoe is located in the channel, for resisting sliding of said pivot shoe along the track when the barrel cam is rotated over a third angle of said predetermined angular range, said radial thrust cam also being for permitting retreat of said first leg from said engagement with the inner face of the track when said barrel cam is rotated over a fourth angle of said predetermined angular range, a brake pad extending over said first end of said barrel cam, and mounted on said body for axial movement for said engaging of the first inner face of said track.

8. The pivot shoe as described in claim 7, further comprising:

said body including axial guide means for slidingly receiving said brake pad for said axial movement of said brake pad.

9. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, and a fourth wall generally opposed to and spaced from the first wall, and attached to said second and third walls, said first, second, third, and fourth walls including first, second, third, and fourth inner faces respectively which define a channel for receiving the pivot shoe; said pivot shoe comprising:

a body, including a first, a second, a third side, and a fourth side opposite on the body to said first side, a first portion of said body and a second portion of said body, said fourth side facing said first inner face, said second side facing said second inner face, and said third side facing said third inner face, and said first and second portions being oriented longitudinally with the track when said body is located within said track, said first portion comprising; a first leg and a second leg, said first and second legs defining a separation zone between them for divergent movement of said legs, and further defining between them within said separation zone, a passage between said first and fourth sides for receiving a barrel cam, a barrel cam having a first end and a second end, mounted in said passage for rotation by said rotation transmission means about an axis that is generally normal to said first wall, said first wall comprising an opening extending a length of said track for access to said barrel cam by said rotation transmission means, said first end of said barrel cam and said first side of said body defining between them an axial thrust cam for forcing said fourth side of said body against said first inner face and said barrel cam into engagement with said fourth inner face when the pivot shoe is located in the channel, for resisting sliding of said pivot shoe along the track when the barrel cam is rotated over a first angle of a predetermined angular range, said axial thrust cam also being for permitting retreat of said fourth side of said body from the first inner face of said track and said barrel cam from engagement with said fourth inner face when the barrel cam is rotated over a second angle of said predetermined angular range, said barrel cam and said first leg defining between them a radial thrust cam for forcing said leg away from the axis of said barrel cam for engaging an inner face of the track by said first leg when the pivot shoe is located in the channel, for resisting sliding of said pivot shoe along the track when the barrel cam is rotated over a third angle of said predetermined angular range, said radial thrust cam also being for permitting retreat of said first leg from said engagement with the inner face of the track when said barrel cam is rotated over a fourth angle of said predetermined angular range.

10. The pivot shoe as described in claim 9, further comprising:

said second portion of said body comprising means for receiving means for urging said pivot shoe slidingly along said track.

* * * * *